US011604487B2

(12) United States Patent
Marinca et al.

(10) Patent No.: US 11,604,487 B2
(45) Date of Patent: Mar. 14, 2023

(54) LOW NOISE REFERENCE CIRCUIT

(71) Applicant: Analog Design Services Limited, Clonlara (IE)

(72) Inventors: Stefan Marinca, Clonlara (IE); Thomas O'Dwyer, Clonlara (IE)

(73) Assignee: ANALOG DESIGN SERVICES LIMITED, Clonlara (IE)

( * ) Notice: Subject to any disclaimer, the term of this patent is extended or adjusted under 35 U.S.C. 154(b) by 92 days.

(21) Appl. No.: 17/400,980

(22) Filed: Aug. 12, 2021

(65) Prior Publication Data

US 2022/0075405 A1 Mar. 10, 2022

Related U.S. Application Data

(60) Provisional application No. 63/075,925, filed on Sep. 9, 2020.

(30) Foreign Application Priority Data

Sep. 9, 2020 (GB) ..... 2014195

(51) Int. Cl.
*G05F 3/30* (2006.01)
*G05F 3/26* (2006.01)

(52) U.S. Cl.
CPC ..... *G05F 3/30* (2013.01); *G05F 3/26* (2013.01)

(58) Field of Classification Search
CPC ..... G05F 3/08; G05F 3/225; G05F 3/24; G05F 3/242; G05F 3/245; G05F 3/26; G05F 3/262; G05F 3/265; G05F 3/267; G05F 3/30; G05F 1/46; G05F 1/462; G05F 1/467; G05F 1/468
See application file for complete search history.

(56) References Cited

U.S. PATENT DOCUMENTS

| | | | | |
|---|---|---|---|---|
| 8,508,211 | B1 | 8/2013 | Anderson | |
| 8,531,169 | B2 * | 9/2013 | Marinca | G05F 3/30 323/311 |
| 9,285,820 | B2 * | 3/2016 | Kalb | G05F 3/30 |
| 2006/0250178 | A1 * | 11/2006 | Gierkink | G05F 3/30 327/539 |
| 2009/0039949 | A1 * | 2/2009 | Pietrobon | G05F 3/30 327/539 |
| 2009/0121698 | A1 * | 5/2009 | Harvey | G05F 3/30 327/539 |
| 2011/0241646 | A1 * | 10/2011 | Vyne | G05F 3/30 323/313 |
| 2020/0036366 | A1 * | 1/2020 | Gupta | A61B 5/302 |

OTHER PUBLICATIONS

Combined Search and Examination Report, for Application No. GB2014195.8, dated Feb. 8, 2021.

* cited by examiner

*Primary Examiner* — Thienvu V Tran
*Assistant Examiner* — Shahzeb K Ahmad
(74) *Attorney, Agent, or Firm* — Snell & Wilmer L.L.P.; Kent A. Lembke

(57) ABSTRACT

Reference circuits are described. In particular reference circuits that use a plurality of cascaded proportional to absolute temperature, PTAT, cells are described. In the circuits disclosed, currents of the low current density arm of first PTAT cell are mirrored into the high current density arms of a second PTAT cell such that any deviation of current in the low current density arm of the first cell will be replicated as the current in the high current density arm of the second cell. In this way low noise circuits can be provided.

20 Claims, 7 Drawing Sheets

LOW NOISE REFERENCE CIRCUIT

FIELD

The present invention relates to the field of reference circuits and in particular to high precision and low noise circuits that can be used as voltage or current reference circuits.

BACKGROUND

Reference circuits are widely used. The purposes of the reference circuit is to provide either a voltage or a current whose behavior is understood and which ideally does not fluctuate based on power supply, design process or other parameters. The reference voltage circuit is a key electronic circuit for a large variety of analog circuits like analog to digital converters (DACs), digital to analog converters (DACs), voltage regulators, multipliers, etc. It is also the most important part of precision instrumentation systems. For any silicon-based voltage reference, the most critical parameter is temperature sensitivity. For higher end precision, there are two known basic approaches: bandgap voltage reference and buried Zener diode.

The bandgap voltage concept is based on the base-emitter voltage, $V_{be}$, of a forward biased bipolar transistor. This is the most predictable voltage in an integrated circuit (IC). A typical Vbe value at ambient temperature (T=300K) is of the order of 0.6V to 0.7V, depending on the collector current density. As is known from, for example U.S. Pat. No. 8,531,169, unfortunately, this voltage is very much temperature dependent according to a relationship as defined in equation 1 below:

$$V_{be}(T) = V_{G0} - (V_{G0} - V_{be0}) * \frac{T}{T_0} - XTI * \frac{kT}{q} * \ln\left(\frac{T}{T_0}\right) + \frac{kT}{q} * \ln\left(\frac{I_c(T)}{I_c(T_0)}\right) \quad (1)$$

The symbols in equation 1 have the meanings:

- $V_{be}(T)$, the base-emitter voltage at an arbitrary absolute temperature T;
- $V_{G0}$, extrapolated bandgap voltage;
- $V_{be0}$, base-emitter voltage at a reference temperature $T_0$;
- kT/q, thermal voltage at temperature T;
- XTI, temperature exponent of the saturation current, which is process and stress dependent with typical values between 3 and 5;
- $I_c(T)$, collector current at the temperature T;
- $I_c(T_0)$, collector current at temperature $T_0$.

It will be appreciated that the first two terms in equation 1 correspond to the linear temperature variation of the base-emitter voltage of the bipolar transistor. The last two terms in equation 1 correspond to the non-linear temperature variation. As equation 1 shows, the base emitter voltage, $V_{be}$, exhibits variation with temperatures, specifically its output is complimentary to absolute temperature (CTAT) i.e. when plotted over temperature the base emitter voltage has a negative slope. In the bandgap voltage reference concept, the negative temperature coefficient (TC) of the $V_{be}$ can be cancelled out if combined with a second voltage which is proportional to absolute temperature (PTAT) and which has corresponding values to the base emitter voltage. Such a PTAT voltage can be generated by a base-emitter voltage difference of pairs of bipolar transistors biased with different collector current densities, $\Delta V_{be}$. For two bipolar transistors with different emitter area, $A_E$ and $NA_E$, biased with corresponding collector currents, $I_{c2}$ and $I_{c2}$, the base-emitter voltage difference, $\Delta V_{be}$, is determined from equation 2:

$$\Delta V_{be} = \frac{kT}{q} \ln\left(N \frac{I_{c1}}{I_{c2}}\right) \quad (2)$$

As can be seen this voltage is proportional to absolute temperature. For $I_{c1}=I_{c2}$ and N=8, at ambient temperature, (T=300K), this voltage is of the order of 54 mV. To balance the TC of the $V_{be}$, a PTAT of the order of 500 mV is required. This voltage is usually generated via operational amplifiers with closed loop gains of the order of 10. By gaining up $\Delta V_{be}$ voltage using an amplifier approach, offset voltages and noise are added such that the compound voltage (PTAT+CTAT) has large device to device deviation. In order to reduce these errors different architectures are used.

One architecture with improved performance, according to the U.S. Pat. No. 8,531,169, is presented in FIG. 1. This circuit avoids the need for an amplifier and is based on resistor-less base-emitter voltage difference or PTAT cell, 100. Inside the circuit 100 there are "m" identical cells connected in a stack arrangement: this schematic shows three cells with the output of one cell connected to the input of the next cell. Each cell is based on two bipolar transistors, one of high current density and the other of a low current density. The first cell is based on two bipolar transistors, Q1 of high current density, Q2 of low current density, two NMOS transistors, M1, M2, and two current generators, I1 and I2. The second cell is based on two bipolar transistors, Q3 which is similar to Q1, Q4 which is similar to Q2, two NMOS transistors, M3, M4, and two current generators, I3 and I4; the last or "m-th" cell is based on two bipolar transistors, Qm, Qm+1, two NMOS transistors, Mm, Mm+1, and two current generators, Im and Im+1. The MOS transistors M2, M4 and Mm+1 function as "beta helpers" generating the necessary base currents for the corresponding bipolar transistors. The low current density bipolar transistor and the NMOS transistor in each cell act as a nested amplifier (Q2 and M1 in the first cell; Q4 and M3 in the second cell and Qm+1 and Mm in the last cell). Each cell generates a base-emitter voltage difference, $\Delta V_{be}$, based on the collector current density ratio of the two bipolar transistors according to the relationship defined in equation 2.

The compound PTAT voltage at the output of the stack, which corresponds to the drain node of NMOS transistor Mm is determined from equation 3:

$$V_{PTAT} = m \frac{kT}{q} \ln(N) \quad (3)$$

The CTAT voltage part of the voltage reference consists of the base-emitter voltage of the transistor Qc biased with the output current $I_q$. The voltage V_PTAT can be set, via "m" and "N" factors, to a desired value in order to balance the TC of the Qc base-emitter voltage. As can be seen, the V_PTAT voltage is generated without any explicit gain amplifier, and as such it is not affected by the associated errors that can be attributed to the use of an amplifier. In this way, the noise and errors in each cell are due the two bipolar transistors and the corresponding bias current mirrors only.

An improved version of the circuit has been disclosed in U.S. Pat. No. 9,285,820 as FIG. 2 shows. The circuit 200 of FIG. 2 is based on the use of a stack of cross-quad cells, 20, 22, 24. The first cell 20 is made of four bipolar transistors, Q1, Q2, Q3, Q4, two NMOS transistors, MN1, MN2 and two bias currents generated via the corresponding PMOS mirrors, MP2 and MP3; the second cell 22 is made of four bipolar transistors, Q5, Q6, Q7, Q8, two NMOS transistors, MN3, MN4 and two bias currents generated (via the corresponding PMOS mirrors) MP4 and MP5; the last cell 24 is made of four bipolar transistors, Q9, Q10, Q11, Q12, one NMOS transistor, MN5, two bias currents generated (via the corresponding PMOS mirrors) MP6 and MP7 and an output resistor divider, 28. As in the circuit of FIG. 1 the NMOS transistors MN2, MN4 are configured to generate the base currents of the top two bipolar transistors inside the respective cells. The NMOS transistor, MN5, in the last cell generates the base currents of transistors Q11 and Q12 and the current through the voltage divider 28.

In the cross-quad configuration of this circuit, the bipolar transistors of each cell are arranged in two arms, a left arm and a right arm. Each arm consists of two bipolar transistors, one of high current density and one of low current density. Using the example of the first cell 20, the emitter of the topmost high current density (right arm) transistor Q4 is connected to the base of the high current density transistor (left arm) Q1. Similarly, the emitter of the topmost low current density (left arm) transistor Q3, is connected to the base of the low current density transistor (right arm) Q2. Because of this arrangement the double $\Delta V_{be}$ voltage at the output node of the cell is insensitive to the mismatches and noise of the bias current generators.

The output voltage of each cross-quad cell is a PTAT voltage as determined from equation 4:

$$V_{PTAT} = 2\frac{kT}{q}\ln(N) \tag{4}$$

and the output voltage reference of the cell itself, $V_{REF}$, is determined from equation 5:

$$V_{ref} = (m-1)\frac{kT}{q}\ln(N) + V_{be}(Q9) + V_{be}(Q12) \tag{5}$$

If the two voltages, PTAT and CTAT, are well balanced, the reference voltage corresponds to two bandgap voltages which is of the order of 2.46V. The role of the voltage divider 28 is to generate an output voltage of a standard voltage which can be 2.048V or 2V, or any other value lower than 2.46V.

As has been mentioned, the reference voltage that is generated by a cell per the teaching of FIG. 2, is insensitive to the bias current generator mismatches and noise, but this advantage is true only for bipolar transistors with high current gain factor (β). For β<50 the output voltage noise starts to deteriorate, which is a significant disadvantage for CMOS processes, where the β factor can be as low as 1.5.

Another known low noise voltage reference circuit is presented in FIG. 3. The circuit 300 of FIG. 3 takes advantage of a high supply voltage Vdd increasing the base-emitter voltage difference by stacking more diode connected bipolar transistors vertically. As the circuit shows, there are three identical cells 161, each stacked horizontally relative to one another. Each cell consists of two arms, one of high current density bipolar transistors (Q101, Q103 and Q105 in the first cell; Q111, Q113 and Q115 in the second cell and Q121, Q123 and Q125 in the last cell) and one of the low current density bipolar transistors (Q102, Q104 and Q106 in the first cell; Q112, Q114 and Q116 in the second cell and Q122, Q124 and Q126 in the last cell). The lower node of the low current density arm of a first cell is connected to the lower node of the high current density arm of the second cell; the lower node of the low current density arm of a second cell is connected to the lower node of the high current density arm of the third cell. The lower node of the low current density arm of the last cell is connected to the emitter of a diode connected transistor Q151 setting the CTAT voltage part of the bandgap voltage. The lower node of each lower current density arm is connected to a resistor (R1 for the first cell, R2 for the second cell and R3 for the third cell). The second node of all three resistors, R1, R2 and R3 are connected to the common node or ground. The voltage drop across the last resistor, R3, sets the bias current of the low current density transistors in the last cell as well as the diode-connected devices inside the current mirror block 140. The current mirror block 140 generates four similar currents used to bias the high current density arm in each cell as well as the transistor Q151 whose base-emitter voltage represents the CTAT part of the bandgap voltage.

The voltage drop across resistor R1 is a PTAT voltage drop which can be determined from equation 6:

$$V_{PTAT1} = 3\frac{kT}{q}\ln(N) \tag{6}$$

The voltage drop across the R2 resistor is similarly a PTAT voltage drop which can be determined from equation 7:

$$V_{PTAT2} = 6\frac{kT}{q}\ln(N) \tag{7}$$

The voltage drop across R3 resistor is similarly a PTAT voltage drop which can be determined from equation 8:

$$V_{PTAT3} = 9\frac{kT}{q}\ln(N) \tag{8}$$

The voltage $V_{PTAT3}$ is also the compound PTAT voltage of the bandgap voltage. By stacking this voltage with the base-emitter voltage of transistor Q151 a bandgap reference voltage is set at the commonly coupled collector and base node of Q151.

The prior art circuit of FIG. 3 has two important drawbacks:

1. The three resistors R1, R2 and R3 are large with the result that they can generate a corresponding large voltage noise and require a large area within the circuit layout.
2. The output current noises from the mirror 140 are all correlated (in phase) with the noise of the diode-connected device in 161.

For example, if one considers a current of 7.5 μA in each leg at ambient temperature and N=8, the resistor values of the circuit of FIG. 3 are of the order of R1=10.8 kΩ; R2=20.6 kΩ and R3=32.4 kΩ. The diode-connected device of the current mirror block 140 is biased with half the current through R3 resistor, which is the largest of the three resistors, generating large noise. Accordingly, all mirrors of the current mirror 140 will replicate the corresponding large noise. The noise is therefore enhanced.

It will therefore be appreciated that there continues to be a need to provide a circuit that can minimize noise contributions and yet provide an effective voltage reference.

SUMMARY

Accordingly there is provided a reference circuit that uses a combination of cascaded proportional to absolute temperature, PTAT, cells with mirroring circuitry to reduce overall noise within the circuit.

Each PTAT cell comprises a low current density arm and a high current density arm, each of which comprise a plurality of vertically stacked transistors. Each arm is coupled to the other arm via a resistor, and each cell is configured to generate a base emitter voltage difference proportional to a ratio of current passing through the high current density arm to the current passing through the low current density arm.

The mirroring circuitry comprises a plurality of PMOS transistors, and is configured such that currents of the low current density arms of a first PTAT cell are mirrored into the high current density arms of a second PTAT cell such that any deviation of current in the low current density arm of the first cell will be replicated as the current in the high current density arm of the second cell.

The resistor of a first PTAT cell of the plurality of cascaded PTAT cells is coupled at a first side to the high current density arm of the first cell and at a second side to each of the low current density arm of the first cell and to a high current density arm of the second cell of the plurality of cascaded PTAT cells. The resistors of each cell optimally set the corresponding bias currents in preferred implementations each resistor has a different value to the resistor in the preceding cell. In this way the resistors can have a ratio relationship that is based on integer values which results in superior accuracy in the division of the resistor values than is possible using known circuits.

Accordingly there is provided a circuit as detailed in claim 1. Advantageous features are in the dependent claims.

BRIEF DESCRIPTION OF THE DRAWINGS

The present teaching will be explained with reference to the figures of the accompanying drawings, which are meant to be exemplary and not limiting, and in which like references are intended to refer to like or corresponding parts.

DETAILED DESCRIPTION

Figure 1:
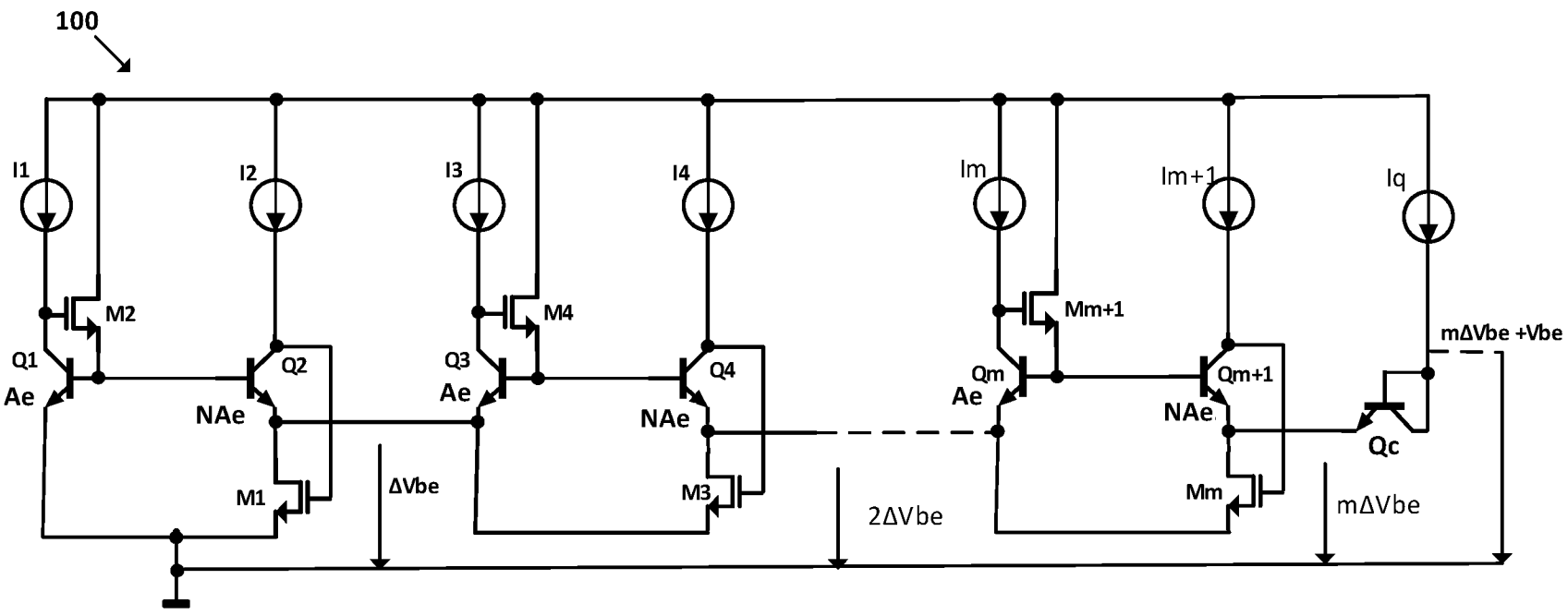
Figure 1 PRIOR ART
FIG. 1 is an example of a known voltage reference circuit.
Figure 2:
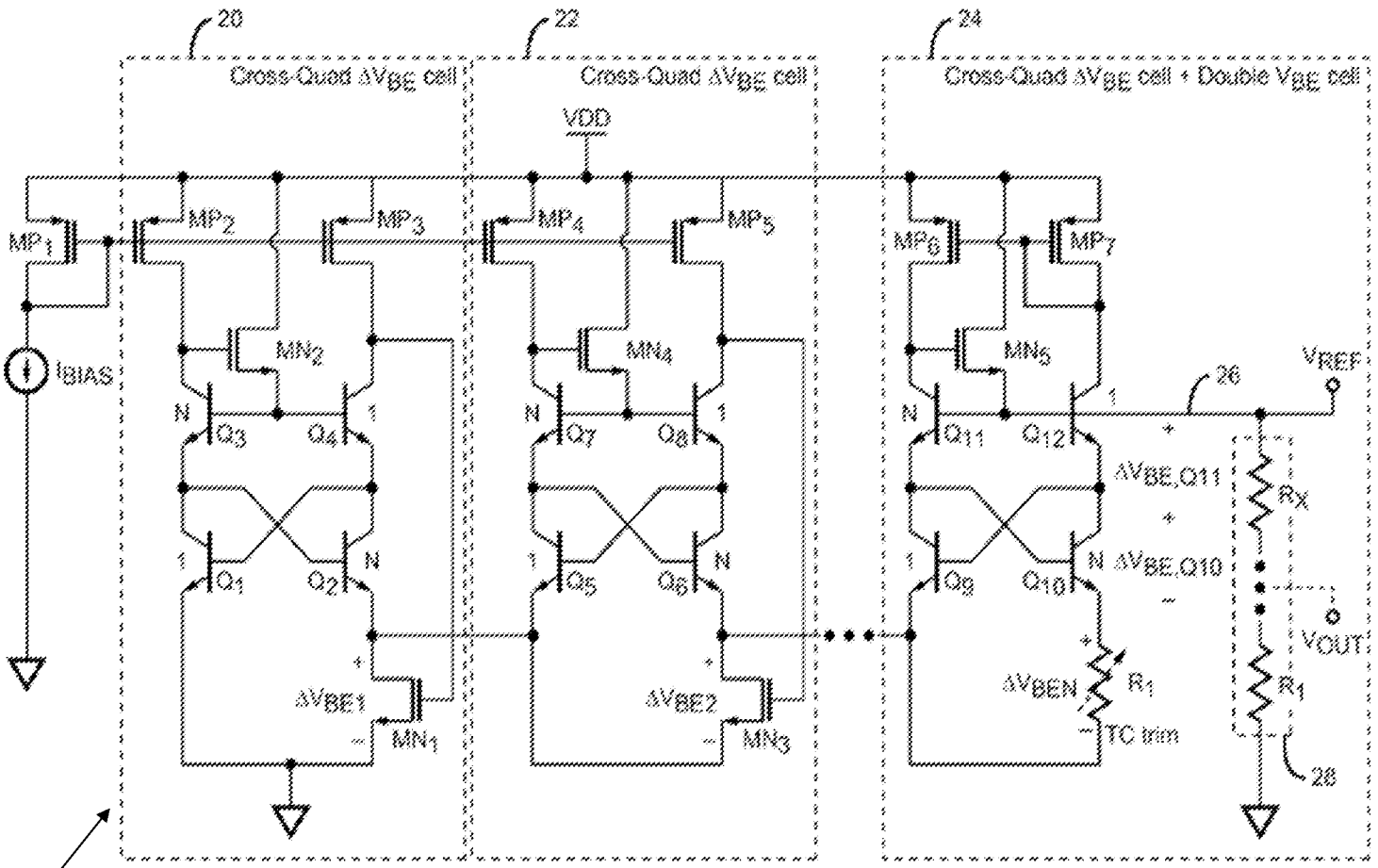
Figure 2 PRIOR ART
FIG. 2 is an example of a known voltage reference circuit based on a cross-quad arrangement.

Prior art circuits have been described with reference to FIGS. 1 to 3.

Figure 4:
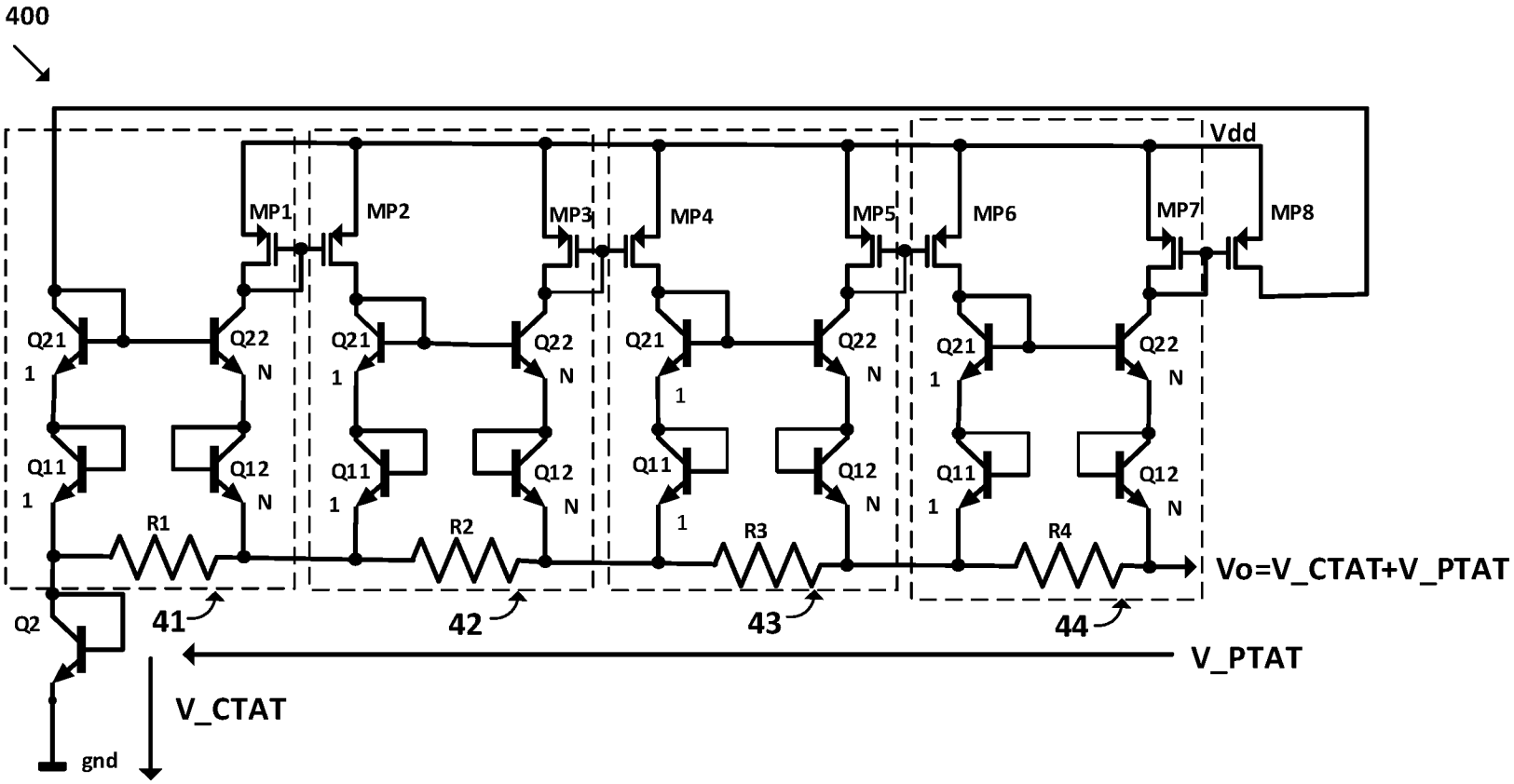
FIG. 4 is an example of a voltage reference circuit in accordance with the present teaching.

A low noise bandgap voltage reference according to the first embodiment of the present teaching is presented in FIG. 4. The circuit 400 consists of a stack of four similar base-emitter voltage difference cells, 41, 42, 43 and 44. Each cell constitutes a proportional to absolute temperature, PTAT, cell. In this example, four PTAT cells are cascaded relative to one another. Each PTAT or base-emitter voltage difference cell comprises one high current density arm and one low current density arm. Using the example of the first cell, cell 41, the high current density arm is made of two unity emitter area bipolar transistors, Q11 and Q21; the low current density arm is made of two bipolar transistors with larger emitter area (N times unity area), Q12 and Q22. The topmost high current density transistor, Q21, in each cell is diode connected. The emitters of lower most transistors (Q11, Q12 in this exemplary cell) are coupled via a resistor R1 which functions to set a bias current for the cell. In this way, each PTAT cell comprises multiple high current density bipolar transistors which are stacked vertically relative to one another, and multiple low current density bipolar transistors which are stacked vertically relative to one another, the output PTAT voltage being proportional to the number of transistors in each stack.

The collector of the topmost low current density transistor Q22 is directly connected to a diode connected PMOS transistor, in this example MP1. This diode connected PMOS current mirrors equal currents via a similar PMOS transistor in the high current legs of the next cell, in this example MP2.

As FIG. 4 shows the diode connected PMOS transistors are: MP1 in cell 41; MP3 in cell 42; MP5 in cell 43 and MP7 in cell 44. By providing each of these PMOS transistors in each of the cells, the currents of the low current density legs are mirrored via four current mirrors, MP2, MP4, MP6, MP8, into the high current density legs.

Each arm of any one cell is coupled to the other arm of the respective cell via a resistor. In this way each cell of the plurality of cascaded PTAT cells has a resistor (R1, R2, R3 and R4). As is evident from FIG. 4, a resistor R1 of a first PTAT cell 41 of the plurality of cascaded PTAT cells is coupled at a first side to the high current density arm (Q11, Q21) of the first cell 41 and at a second side to each of the low current density arm (Q12, Q22) of the first cell 41 and to a high current density arm (Q11, Q21) of the second cell 42 of the plurality of cascaded PTAT cells. A similar arrangement is provided for each of the resistor R2 of the second cell 42, and the resistor R4 of the third cell 43. The resistor R4 of the last cell 44 of this exemplary circuit is coupled at its first side to the high current density arm (Q11, Q21) of the last cell 41. Its second side is coupled to the low current density arm (Q12, Q22) of the last cell 41 and it is at this node that an output voltage of the circuit is provided.

The four resistors, R1, R2, R3 and R4, optimally set the corresponding bias currents and optimally each resistor has a different value to the resistor in the preceding cell with the higher resistor value being the value associated with R4. For the same bias current, $I_b$, in each leg the currents passing through the four resistors are $I_{R1}=I_b$; $I_{R2}=3I_b$; $I_{R3}=5I_b$, $I_{R4}=7I_b$. Based on these the four resistors are related through the relationships detailed in Equation 9:

$$R_3 = \frac{R_4}{3};\ R_2 = \frac{R_4}{5};\ R_1 = \frac{R_4}{7} \tag{9}$$

It will be noted that these ratios are integer values and therefore can easily be implemented with unit resistors based on the value of R4. For example, R3 can consist of three resistors in parallel, each equal to R4; R2 can consist of five resistors in parallel, and so on. This results in superior accuracy in the division of the resistor values compared to the non-integer ratios required for example per a circuit implemented in accordance with the teaching of the circuit of FIG. 3. This is a significant advantage.

Investigation of the operation of a circuit per the teaching of FIG. 4 confirms that the voltage drops across all resistors are the same—see equation 10:

$$V_{R1} = V_{R2} = V_{R3} = V_{R4} = 2\frac{kT}{q}\ln(N) \tag{10}$$

For N=8 at ambient temperature (T=300K) these voltage drops are of the order 108 mV.

It will be understood that each of the individual cells 41, 42, 43, 44 contribute a PTAT voltage which is then aggregated to provide the overall PTAT output of the circuit. In the context of circuits that desire an output that is insensitive to temperature variations it is possible to combine these PTAT cells with a contribution from a complimentary to absolute temperature, CTAT, component, the CTAT component being coupled to the PTAT cells to compensate for temperature variation. In this example of FIG. 4. this PTAT temperature variation can be corrected by the contribution of a CTAT constituent provided by the base emitter voltage of the diode connected transistor Q2. The diode connected transistor Q2 is, in this way, coupled to the first PTAT cell specifically to the high density arm of the first PTAT cell and to ground. It will be appreciated that multiple individual PTAT cells are required to match the voltage contribution of the $V_{BE}$ that is provided by this transistor.

Figure 3:
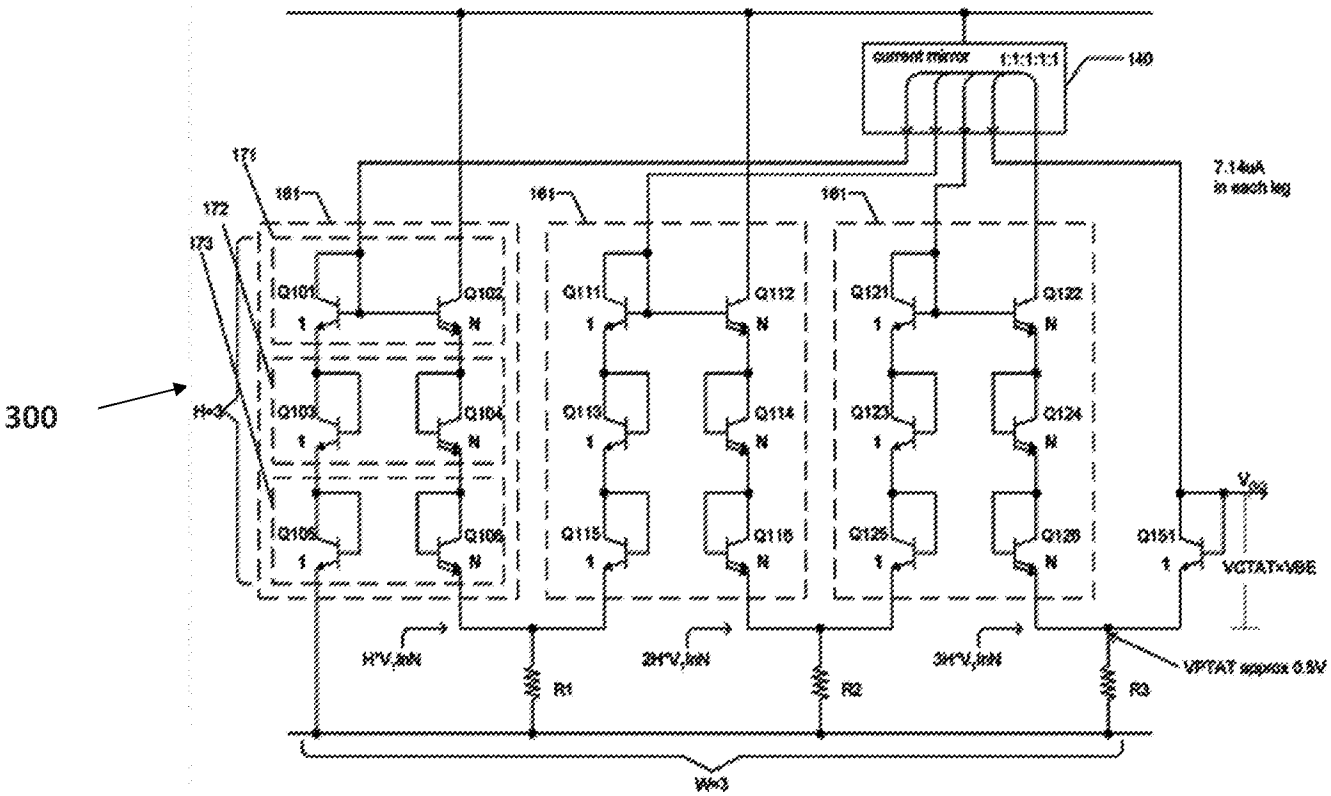
Figure 3 PRIOR ART
FIG. 3 is an example of a known voltage reference circuit.

If the circuit of FIG. 3 and FIG. 4 are compared from the resistor value point of view it can be seen that, for the same bias current in the two circuits, the resistor R3 of the circuit of FIG. 3 is about 4.5 times higher compared to that of R4 in FIG. 4. As a result, if the same supply current is provided to each of the two circuits (FIG. 3 and FIG. 4), the die area occupied by the three resistors of FIG. 3 is about 2.5 larger than that of the four resistors of FIG. 4. In addition, the lower-valued resistors of a circuit per FIG. 4 will generate lower noise voltage.

Another key advantage of the circuit of FIG. 4 over the prior art circuits is related to the noise cancellation of the PMOS current mirrors. This is because all bias currents are generated via the low current density arms and the diode connected PMOS devices (MP1, MP3, MP5, MP7) and the generated bias currents are replicated with the corresponding PMOS current mirrors (MP2, MP4, MP6, MP8) to bias the high current density arm of the next cell.

The bias current of the low current density arm of the cell 41 is mirrored as the bias current in the high current density arm of the cell 42; the bias current of the low current density arm of the cell 42 is mirrored as the bias current in the high current density arm of the cell 43; the bias current of the low current density arm of the cell 43 is mirrored as the bias current in the high current density arm of the cell 44; the bias current of the low current density arm of the cell 44 is mirrored as the bias current in the high current density arm of the cell 41.

As a result, the noise introduced by the diode connected PMOS mirrors of the low current density arms (Q12, Q22) is replicated in the high current density arms (Q11, Q21) of the next cell. As the base-emitter voltage difference in each cell is set by the ratio of the current passing through the high current density arm to the current passing through the low current density arm any deviation (mismatch or noise) of the current in one low current density arm will be replicated as the current in the high current density arm of the next cell. Accordingly, one base-emitter voltage difference will be affected in one direction and the next base-emitter voltage difference will be affected in opposite direction. As a result, the base-emitter voltages are stabilized against mismatch and noise induced by the PMOS current mirrors: MP2, MP4, MP6, MP8.

A circuit according to FIG. 4 has been simulated. In the simulation, all high current density bipolar transistors, Q11, Q21, and Q2 were unity area devices provided by the process; all low current density bipolar transistors, Q12, Q22, consist of eight similar transistors connected in parallel; all PMOS transistors, MP1 to MP8, were of W=20 μm and L=20 μm; the higher resistor value is R4=15.3 kΩ; the other resistors are: R3=R4/3, R2=R4/5, R1=R4/7. The bias current at ambient temperature in each arm was 7 uA. Total supply current at ambient temperature is Idd=63 uA. Simulated noise spectral density (NSD) at ambient temperature was determined to be NSD=26 nV/$\sqrt{Hz}$. In order to quantify the improvement, a circuit per the teaching of FIG. 3 was also simulated. The resistor values were set such that total supply current would be the same for each of the two circuits. A value of 63 μA was used. It was identified that the total number of transistors required for a circuit per FIG. 3 is 82 and for the circuit of FIG. 4, that number reduces to 73.

In addition, the noise spectral density for the circuit of FIG. 3 was found to be 41.5 nV/$\sqrt{Hz}$, compared to only 26 nV/$\sqrt{Hz}$ for FIG. 4.

In this way, it will be appreciated therefore that a circuit per the teaching of FIG. 4 offers a 10% area reduction and almost half the noise for the same supply current.

Figure 5:
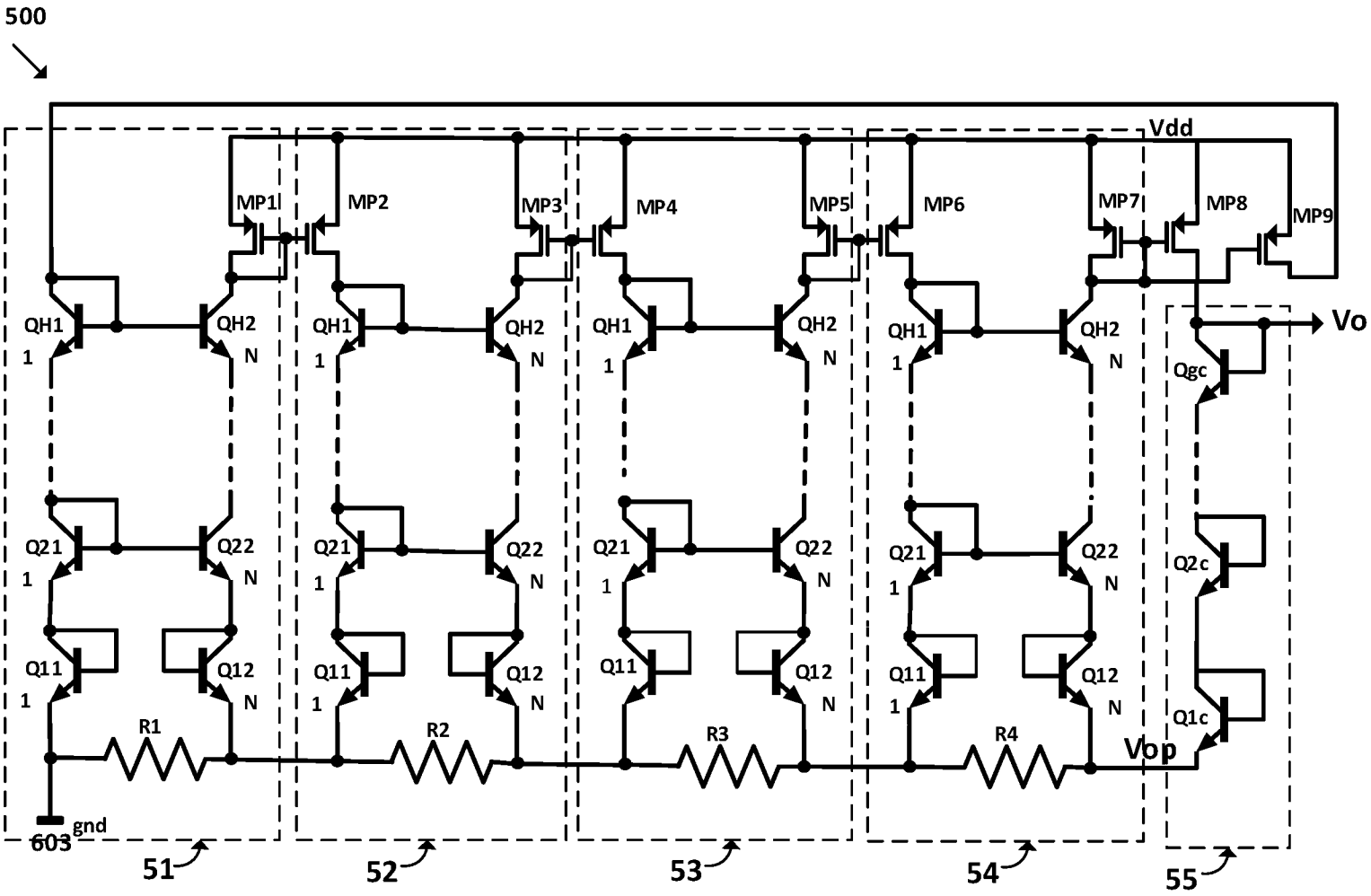
FIG. 5 is an example of another voltage reference circuit in accordance with the present teaching.

A second embodiment of a reference circuit in accordance with the present teaching is presented in FIG. 5. The circuit 500 of FIG. 5 comprises four PTAT or base-emitter voltage difference cells, 51, 52, 53, 54, which are configured similarly to the PTAT cells that were referenced in FIG. 4. FIG. 5 differs in that a dedicated CTAT voltage block or CTAT cell, 55 is coupled to each of the low current density arm of a last PTAT cell 54 of the plurality of PTAT cells and the current mirror, as opposed to the high density arm of the first PTAT cell of the plurality of cascaded cells, per the transistor Q2 of FIG. 4. In a similar way however, the CTAT cell 55 of FIG. 5 is used to generate the CTAT voltage necessary to compensate for the PTAT constituent of the cells. As shown in FIG. 5 this CTAT voltage block 55 is coupled to the output of the final cell 54 and to the mirror circuitry. In this example, the CTAT cell comprises a plurality of diode connected transistors (Qgc, Q2*c*, Q1*c*) stacked relative to one another but it will be appreciated that only one diode connected transistor may be required. A circuit per FIG. 5 is particularly advantageous for applications operating in larger supply voltage environments, whereas the circuit of FIG. 4 is better suited to lower supply voltage environments.

In this exemplary circuit each of the four base-emitter voltage difference cells 51, 52, 53, 54 comprises, two arms. Similarly to FIG. 4, each cell comprises a high current density arm (Q11, Q21 . . . QH1) and a low current density arm (Q12, Q22, . . . , QH2). In the example of FIG. 5, the high current density arm comprises multiple high current density bipolar transistors which are stacked vertically relative to one another—Q11, Q21, . . . , QH1. The low current density arm similarly comprises a plurality of vertically stacked low current density bipolar transistors, Q12, Q22, . . . , QH2. The low current density bipolar transistors are desirably formed from "N" similar transistors which are connected in parallel.

Each cell (51, 52, 53, 54) comprises PMOS devices (MP1, MP9) which are arranged similar to the PMOS devices (MP1, MP8) of FIG. 4 in that the bias current of the low current density arm of the cell 51 is mirrored as the bias current in the high current density arm of the cell 52; the bias current of the low current density arm of the cell 52 is mirrored as the bias current in the high current density arm of the cell 53; the bias current of the low current density arm of the cell 53 is mirrored as the bias current in the high current density arm of the cell 54; the bias current of the low current density arm of the cell 54 is mirrored as the bias current in CTAT arm cell 55. As a result, and again as will be familiar from the teaching of FIG. 4, the noise introduced by the diode connected PMOS mirrors of the low current density arms is replicated in the high current density arms of the next cell. As the base-emitter voltage difference in each cell is set by the ratio of the current passing the high current density arm to the current passing through the low current density arm any deviation (mismatch or noise) of the current in one low current density arm will be replicated as the current in the high current density arm of the next cell. All PMOS devices, MP1 to MP9, have the same aspect ratio (W/L).

Again, it will be appreciated that the PTAT cells 51-54 each provide an individual PTAT contribution that when aggregated forms a PTAT output of the circuit. This PTAT output can be combined with a CTAT contribution to compensate for respective temperature variations. In this exemplary circuit, the CTAT part of the voltage reference is generated inside the CTAT block 55 consisting of a stack of "g" diode connected bipolar transistors. The four resistors are scaled based on the currents passing them: R3=2R4, R2=4R4, R1=6R4.

The output PTAT voltage is determined from Equation 11:

$$V_{op} = 4 * H * \frac{kT}{q} \ln(N) \tag{11}$$

Where H is the number of stacked devices in each arm of the cascaded cells. In this example the effect is demonstrated using four cascaded cells, but the person of skill will appreciate that this can be adjusted to any integer number to achieve different $V_{op}$ voltage values. The reference voltage value is set by the number g of diode connected transistor in the CTAT stack, 55. The corresponding reference voltage values in this case are: 1.23V for g=1; 2.46V for g=2; 3.69V for g=3; 4.92V for g=4; 6.15V for g=5; 7.38V for g=6; 8.61V for 7; 9.84V for g=8 and 11.07V for g=9.

It will be understood that as the number g of the stacked transistors in the CTAT block (55) or the number H of the stacked transistors in the base-emitter voltage cells (51, 52, 53, 54) increases so the minimum required supply voltage increases. A key advantage of the circuit of FIG. 5 is low noise. This is due to the fact that as the base-emitter voltage is scaled up by a factor of "g", the total noise is scaled up by the factor of $\sqrt{s}$. The circuit of FIG. 5 also has the two key advantages of the circuit of FIG. 4: low value resistors and good matching and low noise due to the PMOS current mirrors.

It will be appreciated that the circuits of FIG. 4 or FIG. 5 provide, through a combination of PTAT and CTAT components, a temperature independent output voltage. It will be appreciated however that currents within the circuits can be adapted to produce a current output as opposed to a voltage output. These currents can be provided as PTAT currents, CTAT currents, or temperature independent currents depending on the circuit configurations. For example, current mirrors can be coupled to the individual arms of the PTAT cells and then combined with a diode connected transistor to provide a temperature dependent, or temperature independent, current output.

Figure 6:
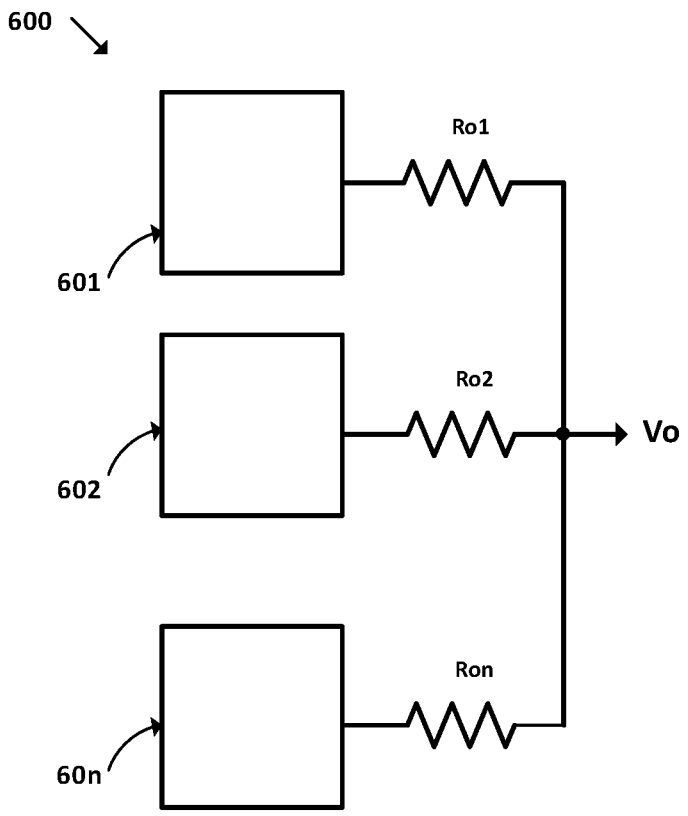
FIG. 6 is an example of another voltage reference circuit in accordance with the present teaching where a number of "n" reference voltage cells, such as those provided by the circuits of FIG. 4 or FIG. 5, can be arranged in parallel with one another for ultra-low-noise applications.

In accordance with the present teaching it is possible to arrange a plurality of individual circuits such as those provided in FIG. 4 or FIG. 5 in parallel with one another. Such an arrangement is particularly useful for ultra-low noise voltage references, and an example is presented in FIG. 6. In the circuit of FIG. 6, a number of "n" reference voltage cells like circuit 400 of FIG. 4 or 500 of FIG. 5 are parallel connected via n small resistors, Ro1, Ro2, Ron. In this exemplary schematic three cells 601, 602, 603 are provided. If each cell exhibits a noise voltage of $v_{n1}$, the compound noise is $$\frac{v_{n1}}{\sqrt{n}}.$$

Figure 7:
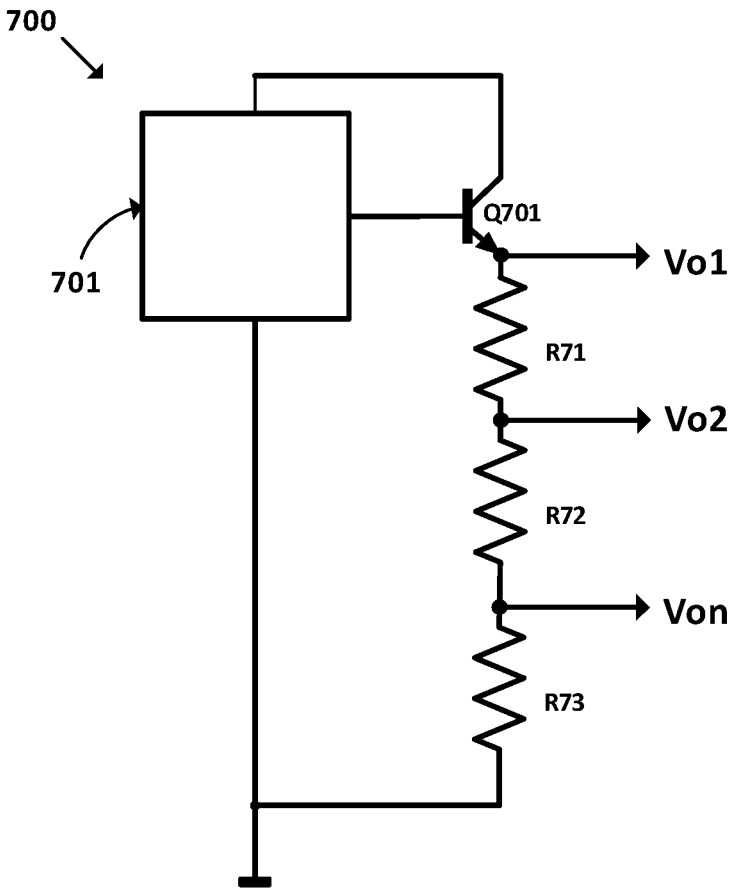
FIG. 7 is an example of a variable output reference circuit whereby a voltage divider is coupled to a buffered output of a circuit per the teaching of FIG. 4 or FIG. 5.

The individual circuits of FIG. 4 or 5 can also be arranged with additional circuitry at their output in the event that specific output voltages are required. For example, as shown in FIG. 7 where the block 701 represents a circuit such as that provided in either FIG. 4 or FIG. 5, it is possible to buffer the output of the voltage reference circuits, for example from 10.000V down to 5.000V or 4.096V, 2.046V, 1.024V, 1V and so on. It will be appreciated that typical output voltages of a reference voltage circuit of FIG. 4 or 5 will range from 1.23V to 11.07. This output can be buffered based on a bipolar transistor Q701, connected to a voltage divider, consisting of a stack of the corresponding resistors, R71, R72, R73. By tapping at any of the nodes Vo1, Vo2, Vo3, different corresponding output voltages can be obtained.

Those skilled in the art will readily understand that the concepts described above can be applied with different devices and configurations. Although the present invention has been described with reference to particular examples and embodiments, it is understood that the present invention is not limited to those examples and embodiments. The present invention as claimed, therefore, includes variations from the specific examples and embodiments described herein, as will be apparent to one of skill in the art. For example, bipolar transistors can be used instead of MOS transistors. Accordingly, it is intended that the invention be limited only in terms of the appended claims.

The invention claimed is:

1. A reference circuit comprising:

a plurality of proportional to absolute temperature, PTAT, cells, each PTAT cell being cascaded relative to one another, wherein each PTAT cell comprises a low current density arm and a high current density arm, each of the low current density arms and the high current density arms comprising a plurality of vertically stacked transistors, each arm being coupled to the other arm via a resistor, each cell being configured to generate a base emitter voltage difference proportional to a ratio of current passing through the high current density arm to the current passing through the low current density arm;

a current mirror comprising a plurality of PMOS transistors, the current mirror being configured such that currents of the low current density arms of a first PTAT cell are mirrored into the high current density arms of a second PTAT cell such that any deviation of current in the low current density arm of the first cell will be replicated as the current in the high current density arm of the second cell; and wherein the resistor of a first PTAT cell of the plurality of cascaded PTAT cells is coupled at a first side to the high current density arm of the first cell and at a second side to each of the low current density arm of the first cell and to a high current density arm of the second cell of the plurality of cascaded PTAT cells.

2. The reference circuit of claim 1 wherein the resistor of the first cell of the plurality of cascaded PTAT cells has a value that is less than the resistor of the second cell of the plurality of cascaded PTAT cells.

3. The reference circuit of claim 1 wherein resistors in each cell of the plurality of PTAT cells have values that are integer ratios of each other.

4. The reference circuit of claim 1 comprising a complimentary to absolute temperature, CTAT, component, the CTAT component being coupled to the PTAT cells to compensate for temperature variation.

5. The reference circuit of claim 4 wherein the CTAT component comprises a diode connected transistor coupled to the first PTAT cell.

6. The reference circuit of claim 5 wherein the CTAT component is coupled to the high density arm of the first PTAT cell and to ground.

7. The reference circuit of claim 6 wherein an output node of the circuit is provided at the low current density arm of a last PTAT cell of the plurality of PTAT cells.

8. The reference circuit of claim 4 wherein the CTAT component comprises a CTAT cell comprising at least one diode connected transistor, the CTAT cell being coupled to each of the low current density arm of a last PTAT cell of the plurality of PTAT cells and the current mirror.

9. The reference circuit of claim 8 wherein the CTAT cell comprises a plurality of diode connected transistors stacked relative to one another.

10. The reference circuit of claim 8 configured such that the CTAT cell and plurality of cascaded PTAT cells are configured to compensate for temperature variations.

11. The reference circuit of claim 8 wherein an output node of the circuit is provided at the CTAT cell.

12. The reference circuit of claim 1 wherein each PTAT cell comprises multiple high current density bipolar transistors which are stacked vertically relative to one another, and multiple low current density bipolar transistors which are stacked vertically relative to one another, the output PTAT voltage being proportional to the number of transistors in each stack.

13. The reference circuit of claim 1 wherein a low current density arm transistor is formed from a plurality, N, of similar transistors which are connected in parallel with one another.

14. The reference circuit of claim 1 configured to provide a voltage output.

15. The reference circuit of claim 1 configured to provide a current output.

16. A low noise reference circuit comprising:

a plurality of reference circuits each comprising:

a plurality of proportional to absolute temperature, PTAT, cells, each PTAT cell being cascaded relative to one another, wherein each PTAT cell comprises a low current density arm and a high current density arm, each of the low current density arms and the high current density arms comprising a plurality of vertically stacked transistors, each arm being coupled to the other arm via a resistor, each cell being configured to generate a base emitter voltage difference proportional to a ratio of current passing through the high current density arm to the current passing through the low current density arm; and a current mirror comprising a plurality of PMOS transistors, the current mirror being configured such that currents of the low current density arms of a first PTAT cell are mirrored into the high current density arms of a second PTAT cell such that any deviation of current in the low current density arm of the first cell will be replicated as the current in the high current density arm of the second cell, wherein the resistor of a first PTAT cell of the plurality of cascaded PTAT cells is coupled at a first side to the high current density arm of the first cell and at a second side to each of the low current density arm of the first cell and to a high current density arm of the second cell of the plurality of cascaded PTAT cells, each reference circuit being connected in parallel with one another via a plurality of resistors, and an output of the low noise reference circuit being provided at a common node of the plurality of resistors.

17. The low noise reference circuit of claim 16, wherein each PTAT cell comprises multiple high current density bipolar transistors which are stacked vertically relative to one another, and multiple low current density bipolar transistors which are stacked vertically relative to one another, the output PTAT voltage being proportional to the number of transistors in each stack.

18. A variable output circuit comprising:

a reference circuit comprising:

a plurality of proportional to absolute temperature, PTAT, cells, each PTAT cell being cascaded relative to one another, wherein each PTAT cell comprises a low current density arm and a high current density arm, each of the low current density arms and the high current density arms comprising a plurality of vertically stacked transistors, each arm being coupled to the other arm via a resistor, each cell being configured to generate a base emitter voltage difference proportional to a ratio of current passing through the high current density arm to the current passing through the low current density arm; and a current mirror comprising a plurality of PMOS transistors, the current mirror being configured such that currents of the low current density arms of a first PTAT cell are mirrored into the high current density arms of a second PTAT cell such that any deviation of current in the low current density arm of the first cell will be replicated as the current in the high current density arm of the second cell;

wherein the resistor of a first PTAT cell of the plurality of cascaded PTAT cells is coupled at a first side to the high current density arm of the first cell and at a second side to each of the low current density arm of the first cell and to a high current density arm of the second cell of the plurality of cascaded PTAT cells, an output of the reference circuit being buffered through a transistor to a voltage divider, comprising a plurality of resistors connected in series, the voltage divider providing a plurality of output tap nodes, each output tap node being provided between a respective pair of the series connected resistors, each output tap node providing a corresponding different output.

19. The variable output circuit of claim 18, wherein the resistor of the first cell of the plurality of cascaded PTAT cells has a value that is less than the resistor of the second cell of the plurality of cascaded PTAT cells.

20. The variable output circuit of claim 18, wherein resistors in each cell of the plurality of PTAT cells have values that are integer ratios of each other.

* * * * *